US008967617B2

(12) United States Patent
Saito et al.

(10) Patent No.: US 8,967,617 B2
(45) Date of Patent: Mar. 3, 2015

(54) PRINTING APPARATUS AND METHOD FOR DETECTING ORIGIN OF CONVEYING ROLLER

(71) Applicant: Canon Kabushiki Kaisha, Tokyo (JP)

(72) Inventors: Hiroyuki Saito, Yokohama (JP); Takaaki Ishida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/091,949

(22) Filed: Nov. 27, 2013

(65) Prior Publication Data

US 2014/0077442 A1 Mar. 20, 2014

Related U.S. Application Data

(62) Division of application No. 12/543,991, filed on Aug. 19, 2009, now Pat. No. 8,622,388.

(30) Foreign Application Priority Data

Aug. 25, 2008 (JP) ..... 2008-215888

(51) Int. Cl.
*B65H 5/00* (2006.01)
*B65H 7/02* (2006.01)
(Continued)

(52) U.S. Cl.
CPC . *B65H 7/02* (2013.01); *B41J 11/42* (2013.01); *B41J 13/02* (2013.01); *B65H 7/20* (2013.01)
USPC ..... 271/264; 271/258.01; 271/256

(58) Field of Classification Search
CPC ..... B65H 2404/193; B65H 2511/33
USPC ..... 271/264, 256, 257, 258.01, 258.05
See application file for complete search history.

(56) References Cited

U.S. PATENT DOCUMENTS 4,288,069 A 9/1981 Wallace et al.
4,884,909 A * 12/1989 Watanabe et al. ..... 400/625
(Continued)

FOREIGN PATENT DOCUMENTS

EP 1 782 960 A1 5/2007
JP 2006-240055 A 9/2006
(Continued)

OTHER PUBLICATIONS

Office Action dated Mar. 29, 2012, in Korean Application No. 10-2009-0078571.
(Continued)

*Primary Examiner* — Michael McCullough
*Assistant Examiner* — Howard Sanders
(74) *Attorney, Agent, or Firm* — Fitzpatrick, Cella, Harper & Scinto

(57) ABSTRACT

The present invention is to provide a printing apparatus capable of correctly detecting an origin of a conveying roller for conveying a print medium at the time of its rotation with a simple configuration that does not accompany an increase of cost. For this purpose, the printing apparatus is equipped with a lock mechanism (a lock link lever) for stopping rotation of the conveying roller at a predetermined rotational position and saves a count value of a rotation amount of the conveying roller when the conveying roller is locked by the lock mechanism concerned as origin information. After this, driving of the conveying roller is controlled based on the saved origin information and a phase of rotation of the conveying roller obtained from the count value of the conveying roller.

14 Claims, 21 Drawing Sheets

(51) Int. Cl.

| | |
|---|---|
| ***B41J 11/42*** | (2006.01) |
| ***B41J 13/02*** | (2006.01) |
| ***B65H 7/20*** | (2006.01) |

(56) References Cited

U.S. PATENT DOCUMENTS

| | | | |
|---|---|---|---|
| 6,322,068 | B1 | 11/2001 | Iemura et al. |
| 6,485,210 | B2 | 11/2002 | Choi |
| 6,592,212 | B1 | 7/2003 | Kakutani |
| 6,599,043 | B2 | 7/2003 | Kobayashi et al. |
| 6,702,492 | B2 | 3/2004 | Saito |
| 6,823,132 | B2 | 11/2004 | Saito et al. |
| 7,367,555 | B2 | 5/2008 | Yoshihisa et al. |
| 2007/0098476 | A1 | 5/2007 | Goeree et al. |
| 2007/0200878 | A1 | 8/2007 | Lapstun et al. |
| 2008/0073832 | A1 | 3/2008 | Sudo et al. |
| 2013/0026708 | A1 | 1/2013 | Shingai |

FOREIGN PATENT DOCUMENTS

| | | | |
|---|---|---|---|
| JP | 2007-21933 | A | 2/2007 |
| RU | 2 258 010 | C2 | 8/2005 |

OTHER PUBLICATIONS

Office Action dated Apr. 12, 2013, in Korean Application No. 10-2009-0078571.

Office Action dated Sep. 17, 2010, in Russian Application No. 2009131959/12.

* cited by examiner

PRINTING APPARATUS AND METHOD FOR DETECTING ORIGIN OF CONVEYING ROLLER

This application is a divisional of U.S. patent application Ser. No. 12/543,991, filed Aug. 9, 2009, now U.S. Pat. No. 8,622,388.

BACKGROUND OF THE INVENTION

1. Field of the Invention

The present invention relates to conveyance control of a print medium. Especially, the present invention relates to a configuration for detecting an origin or phase of a conveying roller at the time of its rotation and a method for the same in a configuration of conveying the print medium using the conveying roller.

2. Description of the Related Art

In printing apparatuses in recent years, there is increased printing use of printing photographic images not only on plain papers but also on special purpose papers. In particular, in the ink jet printing apparatus, a trend of a decreased size of an ink drop has progressed and it has become possible to output an image comparative to or better than silver salt photographs with high resolution. With realization of such high resolution of images, higher precision of paper conveyance is also being advanced and there have been proposed a lot of methods whereby the conveying roller such that a metallic shaft is coated with grinding stone is used and methods for controlling conveyance of such a conveying roller with high precision.

For example, Japanese Patent Laid-Open No. 2006-240055 discloses a configuration where a code wheel is provided on the same axis of the conveying roller and slits formed on its circumferential part at equal intervals are detected by an encoder sensor fixed in the apparatus. According to this, a technology of performing drive control of a DC motor for rotating the conveying roller depending on a cycle at which the slits are detected, etc., is disclosed. Then, according to the same document, a method includes acquiring an origin of the conveying roller by having provided a pattern for rotation phase detection, separately from the slits on the code wheel, and detecting the pattern concerned with another sensor in order to correct a conveyance error resulting from eccentricity of the conveying roller.

FIG. 20 is a sectional view for explaining an installation state of the code wheel and the sensors. A film-like code wheel 2002 shares a rotation axis with a conveying roller 2001 and is disposed around its circumference in a spreading manner. Slits 2002*a* that are arranged at equal intervals and are used for detection of positional precision and a belt-like pattern 2002*b* used for phase detection of roller rotation are printed on the code wheel 2002. An encoder sensor 2003 is installed at a position where the slits 2002*a* pass with rotation of the code wheel 2002, and detects a rotation amount of the code wheel 2002, i.e., the conveying roller 2001. On the other hand, an edge sensor 2004 detects the edge of the pattern 2002*b* that moves with the rotation of the code wheel 2002, and the printing apparatus is configured to be able to set the origin of the roller rotation using this detected timing.

FIG. 21 is a diagram showing another example of a configuration for detecting the origin of the conveying roller. In this example, a sensed part 2102 is attached to a part of the conveying roller 2101, and moves in a circle with rotation of the conveying roller 2101. A photo-interrupter 2103 is being fixed at a position where the sensed part 2102 in the apparatus passes and can detect the origin of the conveying roller 2101 from a timing at which the sensed part 2102 intercepts the photo-interrupter 2103.

Thus, in order to perform the conveyance control in a high-precision state while correcting the conveyance error resulting from the eccentricity of the conveying roller, a mechanism for detecting the origin of the conveying roller also becomes necessary, apart from the mechanism for detecting the rotation amount of the conveying roller.

However, since the above-mentioned conventional configuration requires some electronic device elements, such a photo-interrupter for phase detection, and cable wiring for this newly, a cost of the apparatus cannot avoid increasing.

SUMMARY OF THE INVENTION

The present invention is made in order to solve the problems, and its object is to provide a printing apparatus capable of detecting an origin of the conveying roller with a relatively simple configuration, yet such that it does not accompany increase of a cost.

The first aspect of the present invention is a printing apparatus for printing an image on a print medium using a printing head, comprising: a driving unit configured to drive a conveying roller for conveying the print medium; a counting unit configured to count a rotation amount of the conveying roller; a locking unit configured to lock rotation of the conveying roller at a predetermined rotational position; and a detecting unit that uses a count value of the counting unit when the conveying roller is locked by the locking unit as a reference and detects a phase of rotation of the conveying roller obtained by the reference and the count value of the counting unit.

The second aspect of the present invention is a method for detecting an origin of a conveying roller for conveying a print medium in a printing apparatus for printing an image to the print medium using a printing head, comprising: a step of moving a trigger unit configured to lock the conveying roller to a lock position; a rotating step of rotating the conveying roller; a counting step of counting a rotation amount of the conveying roller from start of rotation of the conveying roller in the rotating step to a time when the conveying roller is locked; and a step of storing a count value acquired by the counting step.

Further features of the present invention will become apparent from the following description of exemplary embodiments (With reference to the attached drawings).

DESCRIPTION OF THE EMBODIMENTS

Hereafter, the best forms for carrying out the present invention will be described with reference to the drawings.

First Embodiment

Figure 1:
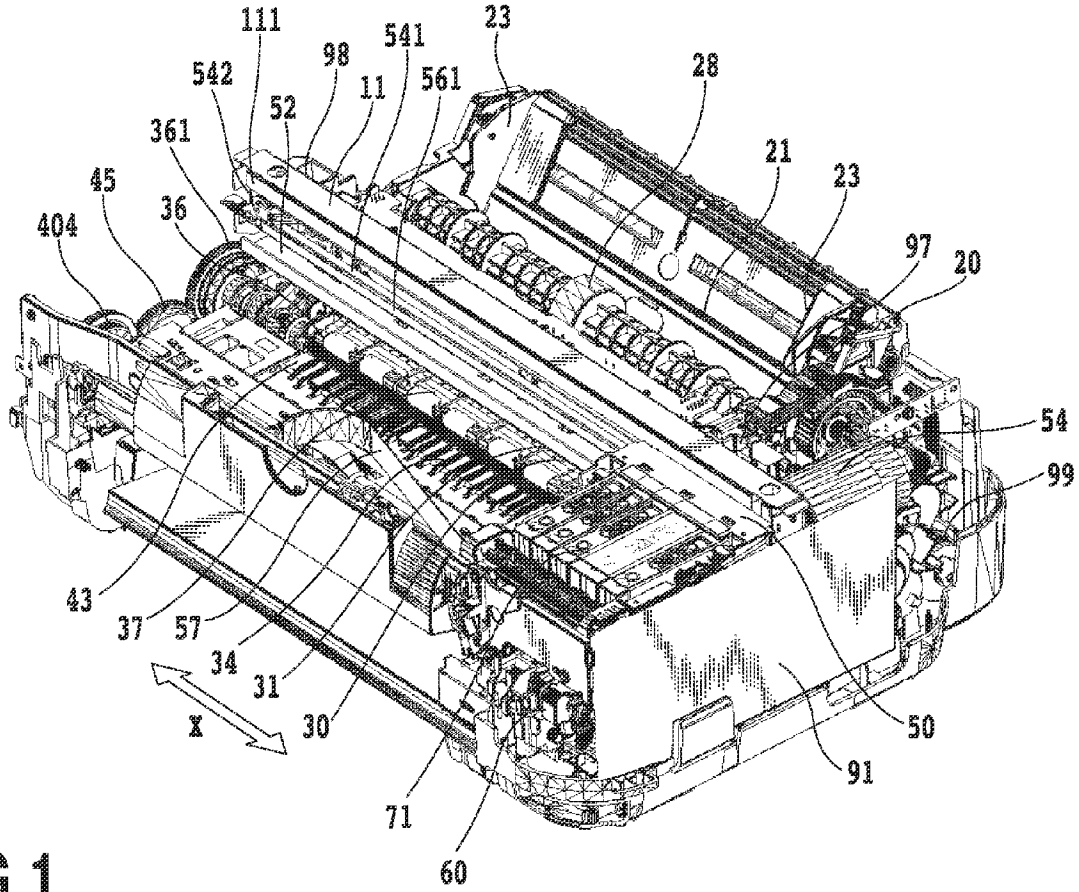
FIG. 1 is a perspective view of a mechanical unit of a printing apparatus applicable to an embodiment of the present invention.

FIG. 1 is a perspective view of a mechanical unit of a printing apparatus in this embodiment.

(A) Conveying Unit

A conveying unit has a configuration that a pressure plate 21 on which print medium is loaded, a feed roller 28 for feeding the print medium P one sheet by one sheet, a separation roller for separating the print medium (not illustrated), a return lever for returning the print medium to its loading position (not illustrated), etc. are attached on a conveying unit base 20. A movable side guide 23 is provided to the pressure plate 21 in a movable manner and regulates the loading position of the print medium. The pressure plate 21 is pivotable about a rotation axis connected to the conveying unit base 20 and is energized in a direction of the feed roller 28 by an unillustrated pressure plate spring. The feed roller 28 has a rod-like shape whose cross section is a circular arc and feeds a print medium into the inside of the apparatus by rotating itself while keeping contact with a surface of the print medium. The print medium bumps against a nip part that is composed of the feed roller 28 and the separation roller, and is divided by this nip part; and only the print medium at the highest position is further conveyed into the inside. A torque of a feed motor 99 is obtained by a process in which a driving force of the feed motor 99 acting as feed driving means is transferred thereto through a drive transferring gear, a planetary gear, etc. The driving force of the feed motor 99 is also transferred to the cleaning unit that will be described later.

(B) Conveying Unit

Main elements of the conveying unit are attached to a metallic plate chassis 11 that is bent and raised and chassis 97, 98 of mold molding. The print medium sent to the conveying unit is guided by a paper guide and a pinch roller holder 30 that are arranged at specified positions of an inlet port, and is held between a roller pair consisting of a conveying roller 36 and a pinch roller 37. The conveying roller 36 has a structure of a metallic shaft with minute particles of a ceramic coated thereon, and metallic portions at both ends thereof are supported by bearing parts fixed to the chassis 11. A plurality of pinch rollers 37 each of which is energized to press the surface of the conveying roller 36 by a pinch roller spring 31 are held by the pinch roller holder 30, and the each pinch roller 37 abuts against the surface of the conveying roller 36 and is driven by this.

Figure 2:
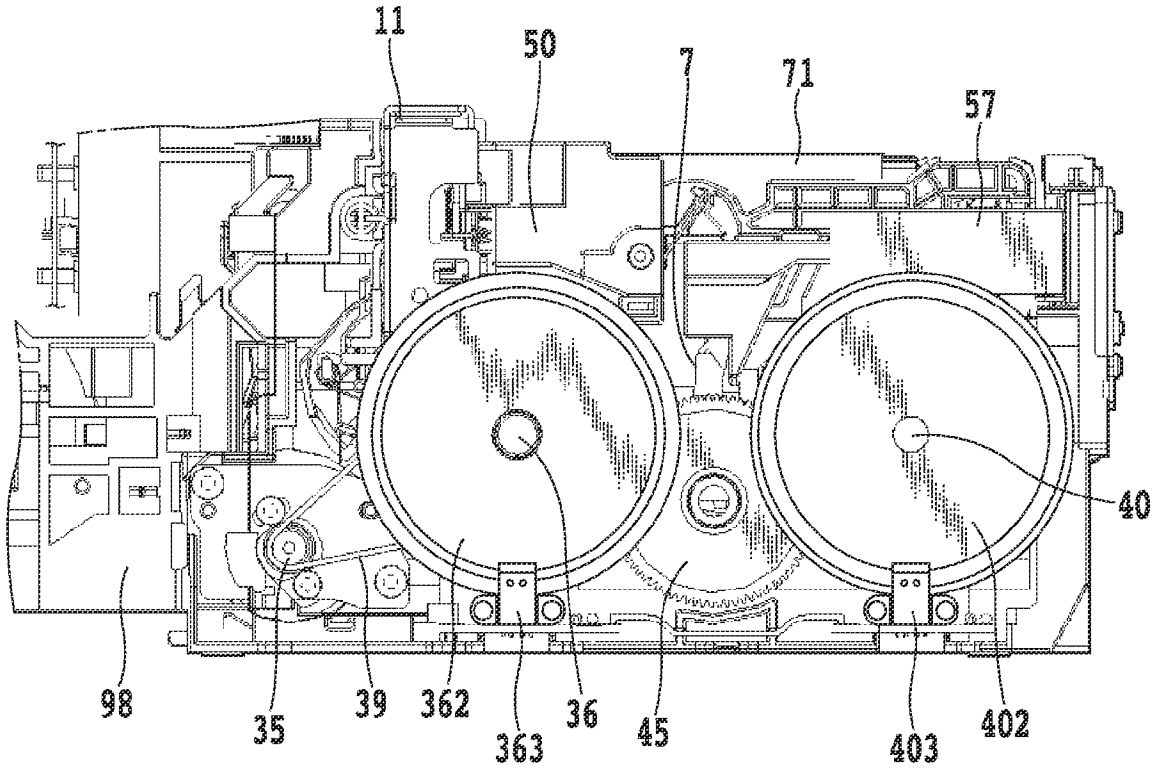
FIG. 2 is a sectional view for explaining in detail a conveying mechanism including a conveying unit in the printing apparatus of the embodiment of the present invention.
Figure 3:
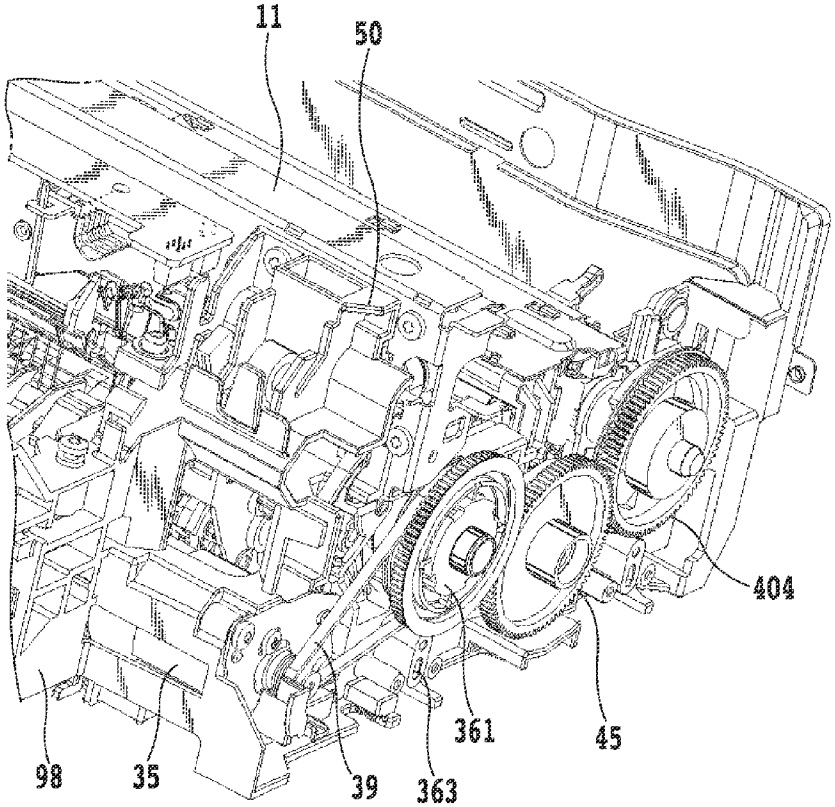
FIG. 3 is a perspective view for explaining in detail the conveying mechanism including the conveying unit in the printing apparatus of this embodiment.

FIGS. 2 and 3 are a sectional view and a perspective view for explaining in detail a conveying mechanism including the conveying unit in the printing apparatus of this embodiment. The torque of the conveying roller 36 is acquired by a process in which a driving force of a conveying motor 35 made up of a DC motor is transferred to a pulley gear 361 provided on the axis of the conveying roller 36 through a timing belt 39. On the same axis of the conveying roller 36, a code wheel 362 on which slits are formed with a pitch of 150 to 360 lpi is directly linked to it. Then, a conveying roller encoder sensor 363 is fixed at a position in the figure of the chassis 11 so as to read the number of times of passing of the slits on the code wheel 362 and its timing.

Referring to FIG. 1 again, when the roller pair consisting of the conveying roller 36 and the pinch roller 37 is rotated by the conveying motor 35, the print medium being held by this roller pair is conveyed in the inside of the apparatus. The pinch roller holder 30 is equipped with an edge sensor for detecting a top end and a rear end of the print medium and for positioning it. By detection with the edge sensor, the print medium is positioned on a platen 34 that is attached to the chassis 11 and is located in a printing unit.

(C) Carriage Unit

On the print medium supported by the platen 34 from below in a downstream side of the conveying roller 36, an image based on print information is printed by a printing head 7 mounted on a carriage 50 that passes over an upper side of the print medium.

The carriage 50 carries the printing head 7 and an ink tank 71 for supplying ink to this, and is movable in the X direction of the figure. The printing head 7 of this embodiment is constructed so that a voltage pulse may be impressed to a heater provided at a position corresponding to the individual discharge port, and the ink may be discharged from the individual discharge port using pressure change produced by growth or contraction of an air bubble in generated film boiling. However, such a discharge method does not limit the present invention.

The carriage 50 is supported by a carriage rail 52 that is extended in a direction at right angles to the conveyance direction of the print medium and an upper guide rail 111 and is guided thereby with respect to its movement direction. The carriage rail 52 is attached to the chassis 11, and the upper guide rail 111 is formed to be integral with the chassis 11. Furthermore, the upper guide rail 111 holds the end of the carriage 50, and also plays the role of maintaining a gap between the discharge port plane of the printing head 7 and the print medium.

The moving force of the carriage 50 is a driving force of a motor 54 attached to the chassis 11 which is supplied thereto through an idle pulley 542 and a timing belt 541 that is provided to the idle pulley 542 in a tensioned state and supported by it. A cord strip 561 in which markings were formed with a pitch of 150 to 300 lpi is provided in a tensioned state in a direction parallel to the timing belt 541, and an unillustrated encoder sensor mounted on the carriage 50 detects the markings during movement of the carriage 50. Thereby, a current position of the carriage 50 can be detected. A flexible cable 57 electrically connects a carriage board on the carriage 50 on which the encoder sensor, etc. is provided with an electric board 91 fixed in the apparatus while following reciprocation of the carriage 50. A printing signal with which the printing head 7 performs printing is transferred thereto from the electric board 91 through the flexible cable 57 and the carriage board. According to this printing signal, individual heaters of the printing head 7 that is during movement are driven, and dots are printed on the print medium on the platen 34.

(D) Discharging Unit

The torque of a discharging roller 40 is obtained by a process where the torque of the conveying roller 36 is transferred to a discharging roller gear 404 directly linked to the discharging roller 40 from the gear part of the pulley gear 361 directly linked to the conveying roller 36 through an idler gear 45. Referring FIG. 2 again, a discharging code wheel 402 is installed on the axis of the discharging roller 40, and a rotation amount of the discharging roller 40 is detected by a discharging roller encoder 403.

A plurality of spurs are attached to a spur holder 43, and these spurs are pressed toward the discharging roller 40 by spur springs each of which is a coil spring provided in a rod-like shape. The print medium on which an image was formed by the printing head 7 is conveyed while being held between the discharging roller 40 and a plurality of nips of these spurs, and is discharged.

(E) Cleaning Unit

A cleaning unit 60 consists of a pump for cleaning the printing head 7, a cap for suppressing drying out of the printing head 7, a blade for cleaning the discharge port plane of the printing head 7, etc. A main driving force of the cleaning unit is obtained by a force being transferred from the feed motor 99 being already explained. The cleaning unit 60 performs a suction operation of sucking unnecessary ink etc. from the printing head 7 by acting a pump with a cap adhered to the printing head 7, a blade operation of cleaning a face surface of the printing head 7 by moving a blade, and the like.

Below, a characteristic configuration of this embodiment will be explained in detail.

Figure 4:
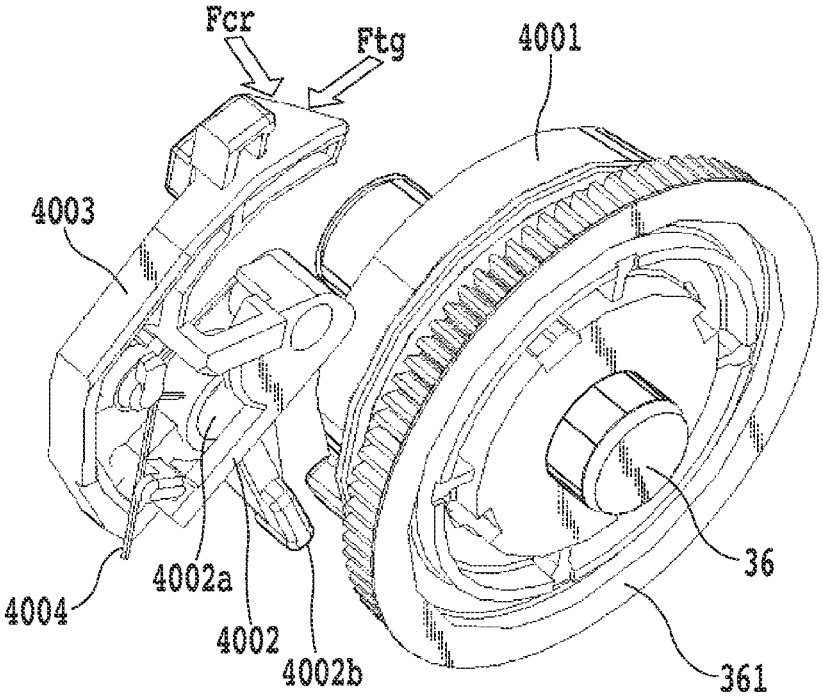
FIG. 4 is a diagram for explaining a mechanism for detecting an origin in a conveying roller of the embodiment of the present invention.
Figure 5:
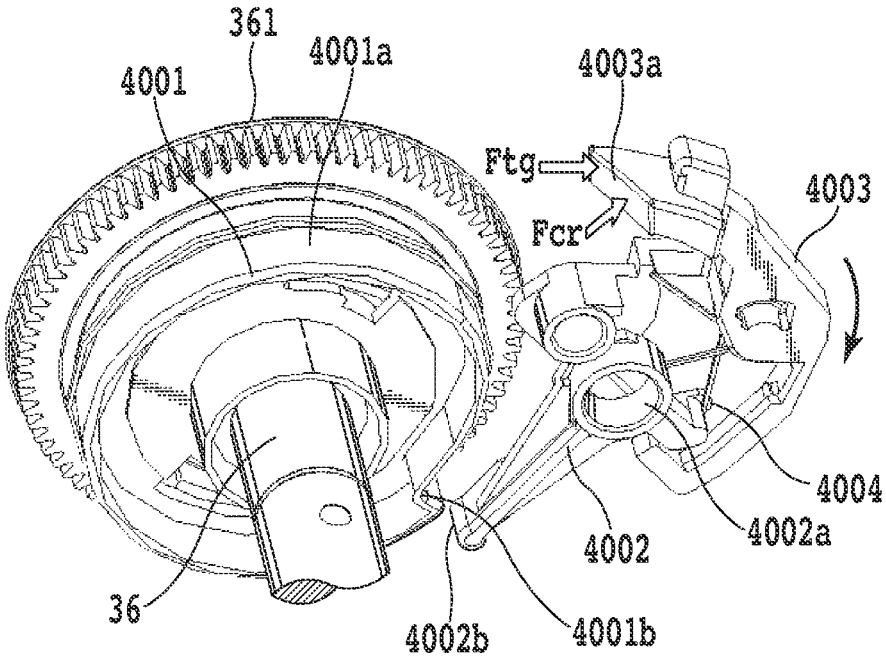
FIG. 5 is a diagram for explaining the mechanism for detecting the origin in the conveying roller of the embodiment of the present invention.

FIGS. 4 and 5 are diagrams for explaining a mechanism for detecting an origin in the conveying roller 36 of this embodiment, wherein FIG. 4 shows the pulley gear 361 on the conveying roller 36 when being observed from its front side, and FIG. 4 shows the same when being observed from its reverse side. A lock ring 4001 is attached to the pulley gear 361, has a circumferential part 4001*a* and a concave part 4001*b*, and rotates integrally with the conveying roller 36. By a stopping lever 4002 rotating about the rotation center 4002*a*, it can stop the lock ring 4001 by bumping the lock part 4002*b* against the concave part 4001*b* of the lock ring 4001. A lock link lever 4003 is a lever for pressing and pulling up the stopping lever 4002, and a pressing force and a pulling up force between the lock link lever 4003 and the stopping lever 4002 is generated by a stopping lever spring 4004. The force Ftg for turning the lock link lever 4003 is generated by the carriage 50 moving to a lock position that is opposite to the home position and is outside the scan area of printing (a left end part of FIG. 1).

Figure 6:
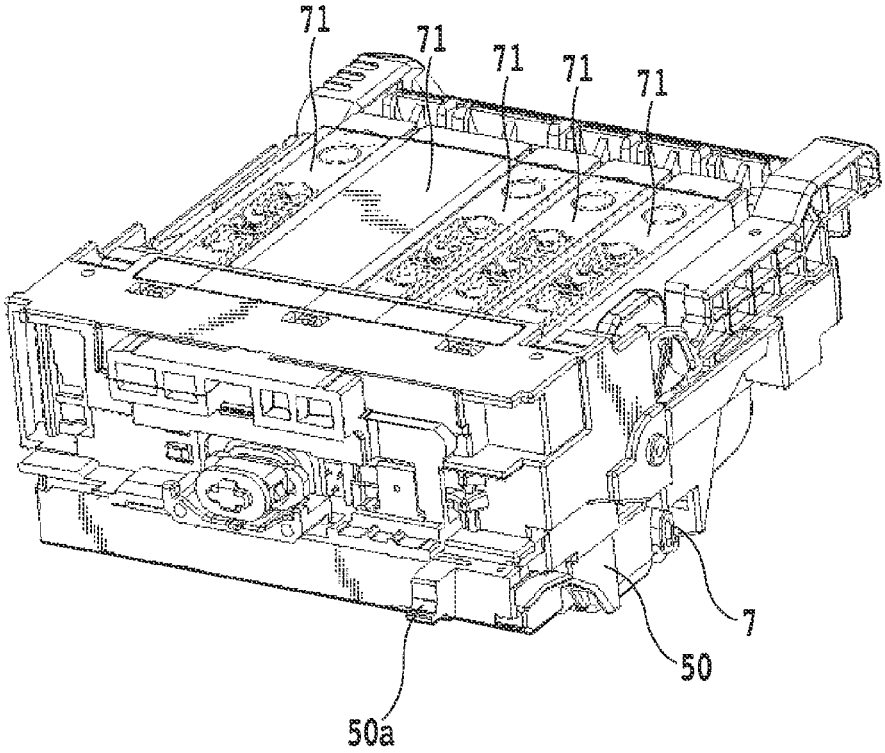
FIG. 6 is a diagram showing a state of the carriage when being observed from its reverse side in the printing apparatus of the first embodiment.

FIG. 6 is a diagram showing a state of the carriage 50 in the printing apparatus of this embodiment when being observed from its reverse side, which is opposite to FIG. 1. A protrusion part 50*a* is attached to the reverse side of the carriage 50. When the carriage 50 moves to the lock position, the protrusion part 50*a* abuts against a slope 4003*a* of the lock link lever 4003. When a predetermined force Fcr is added to the slope 4003*a* of the lock link lever 4003 by such abutment, referring to FIG. 4 or FIG. 5 again, a force Ftg that makes the lock link lever 4003 turn in a direction of an arrow of the figure will occur.

Figure 7A:
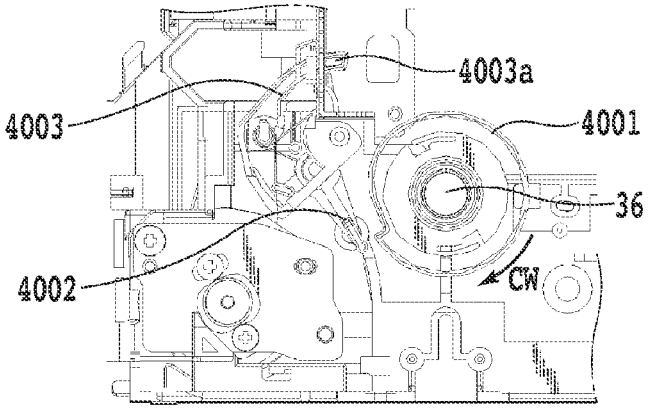
FIGS. 7A to 7C are sectional views for explaining concretely steps where a locking function acts through the mechanism explained by FIGS. 4 to 6.
Figure 7B:
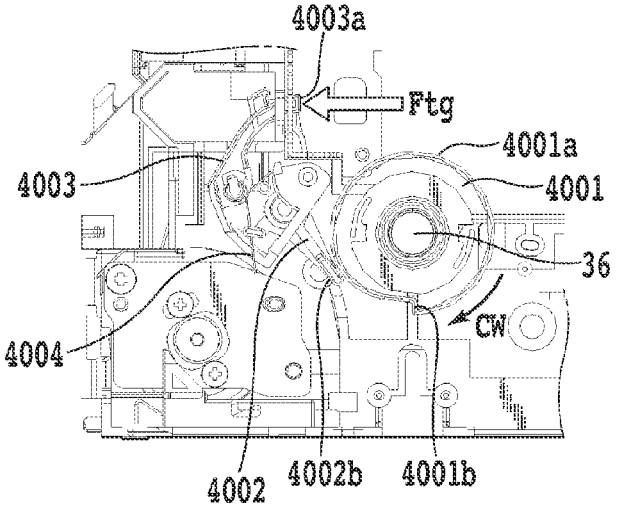
Figure 7C:
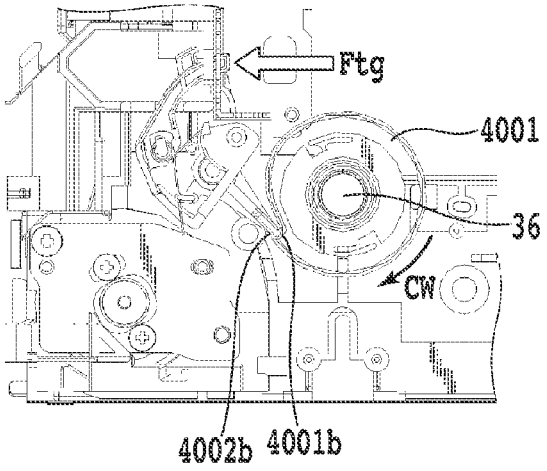

FIGS. 7A to 7C are sectional views for concretely explaining steps where a locking function acts through the mechanism explained by FIGS. 4 to 6.

FIG. 7A is a diagram showing a state where the carriage 50 is not located at the lock position. Since the lock link lever 4003 is not pressed, the lock ring 4001 and the lock ring lever 4002 are isolated from each other. If during the printing operation, the conveying roller 36 and the lock ring 4001 are rotating intermittently in a CW direction of the figure for conveying the print medium.

FIG. 7B shows a state where the carriage 50 moves to the lock position, and the lock link lever 4003 is pressed by the protrusion part 50*a*, a mechanical trigger being given to it. Occurrence of Ftg makes the lock link lever 4003 turn, and the stopping lever 4002 abuts against the circumferential part 4001*a* of the lock ring 4001 by a thrust of the stopping lever spring 4004. At this time, the stopping lever 4002 is configured to be able to make a stroke into the lock link lever 4003 even when the stopping lever 4002 is given a pressure from the circumferential part 4001*a* of the lock ring. Therefore, damage by collision between the protrusion part 50*a* of the carriage 50 and the lock link lever 4003 does not occur. Moreover, with a procedure where the stopping lever 4002 and the lock link lever 4003 are constructed in advance with separate parts in this way, a stroke amount of the lock link lever 4003 and a swing amount of the lock link lever 4003 can be set up separately, respectively. As a result, it is possible to secure the stroke amount that does not depend on tolerances of these parts, just by which the stopping lever 4002 can penetrate positively into the concave part 4001*b* of the lock ring.

FIG. 7C is a diagram showing a state where the conveying roller 36 is further rotated starting from the state of FIG. 7B, and the rotation is locked by the lock ring 4001. When the lock ring 4001 further rotates in the CW direction with the stopping lever 4002 being abutted against the circumferential part 4001*a* of the lock ring 4001, a locking part of the stopping lever 4002 will enter into the concave part 4001*b* of the lock ring 4001. Then, the locking part inhibits the rotation of the lock ring 4001 in the CW direction after this. That is, the lock ring 4001 and the conveying roller 36 are locked so as not to rotate. Incidentally, at this time, since the lock ring 4001 is being fixed to the pulley gear 361 for transferring a driving force from the conveying motor 35, no torque occurs between the conveying roller 36 and the pulley gear 361.

Such a locked state (stopping state) occurs only at one determined position among positions when the conveying roller 36 makes one rotation. Therefore, the position at which the conveying roller was locked (stopped) in this way can be assigned as the origin of the phase of the conveying roller.

Figure 8:
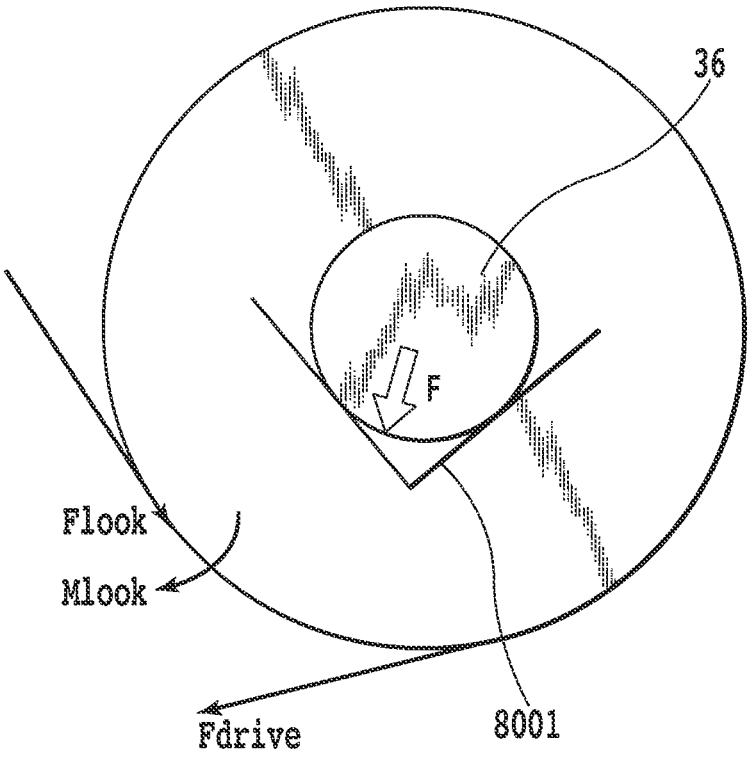
FIG. 8 is a diagram for explaining a direction of a resultant force F resulting from a driving force Fdrive of the conveying roller, a lock reaction force Flock from the stopping lever, and an angular moment Mlock of the lock ring.

Incidentally, it is preferable that the rotation direction of the conveying roller when the locked state is detected is a direction in which the print medium during printing is conveyed (the CW direction), as explained above. Moreover, in the locked state, referring to FIG. 8, the resultant force F resulting from a driving force Fdrive of the conveying roller 36, and a lock reaction force Flock from the stopping lever 4002, and an angular moment Mlock of the lock ring 4001 occurs. In doing this, in order to positively install the conveying roller 36 in the bearing so that reproducibility of conveyance may be secured, it is preferable that individual components are arranged so that the resultant force F may exert in a direction of a bearing 8001 that supports the shaft of the conveying roller 36.

In the above, the lock ring 4001 also bears a function of preventing coming-off of the timing belt 39, and was explained as of a separate configuration from the pulley gear 361 in a mold configuration. However, in the case where there is no possibility that the timing belt 39 may come off, and in the case where the apparatus is configured so that the conveying roller 36 is driven through gears, the lock ring 4001 and the pulley gear 361 may be a monolithic part. Anyway, the constituent components are required to be configured so that the driving force of the conveying motor 35 and the reaction force when the conveying roller 36 is locked may not bring about a shift of rotation phase between the conveying roller 36 and the pulley gear 361, or between the conveying roller 36 and the code wheel 362, or the like. At this time, it is also useful to set up an upper limit to the drive voltage and a pulse width to the conveying motor 35, or to set up an upper limit to the torque in order to prevent damages to parts.

In this embodiment, the state where rotation of the conveying roller 36 is locked (stopped) is determined, referring to FIG. 2, by a state where the conveying roller encoder sensor 363 becomes not to detect the slits on the code wheel 362.

Figure 9A:
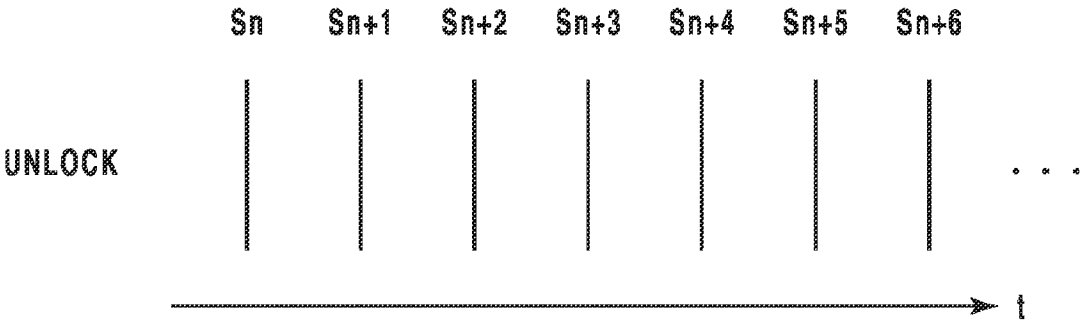
FIGS. 9A and 9B are diagrams showing a timing at which a conveying roller encoder sensor detects slits of a code wheel.
Figure 9B:
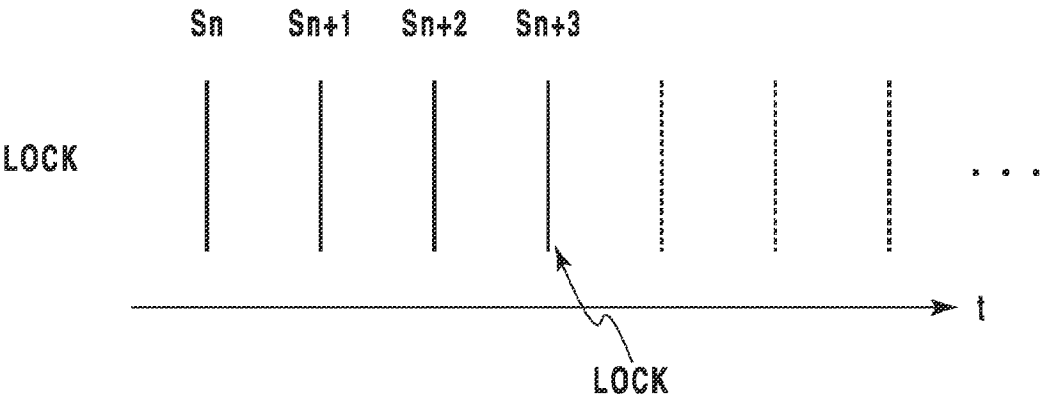
Figure 10:
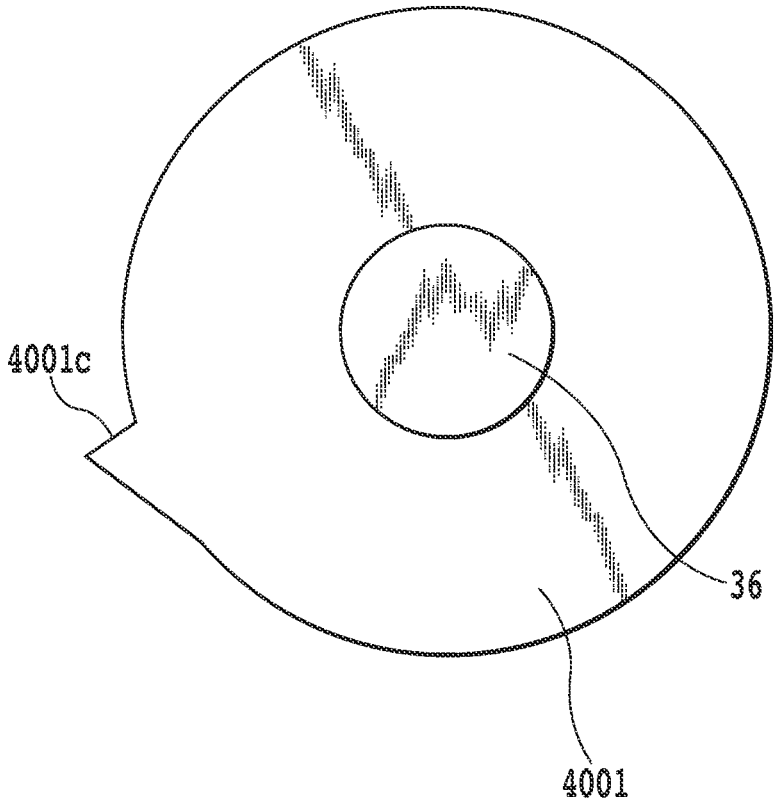
FIG. 10 is a diagram showing another example of shape of the lock ring in the first embodiment.

FIGS. 9A and 9B are diagrams each showing a timing at which the conveying roller encoder sensor 363 detects the slits of the code wheel 362 with respect to a time axis t shown as a horizontal axis. FIG. 9A shows a state where the conveying roller 36 is rotating at a predetermined speed. Here, a state where seven slits Sn to Sn+6 are detected within a predetermined time is shown. Since the slits are formed in the code wheel 362 at regular intervals, when the conveying roller 36 is rotating at a constant speed, the conveying roller encoder sensor 363 detects the slits at such fixed time intervals. On the other hand, FIG. 9B shows a state where the rotation of the conveying roller 36 is being locked on the way. Here, after the slits up to Sn+3 were detected, it becomes that even after the predetermined time has lapsed, the slits after them is not detected. At the timing when this situation occurs, a control unit of the printing apparatus can determine that the conveying roller 36 falls in the locked state.

To be concrete, in the case where the number of detected slits is less than or equal to 10 within a predetermined time of, for example, about 200 ms, it may be determined that the locked state occurs. Moreover, a state may be determined to be the locked state, for example, when the next slit cannot be detected within a predetermined time after the timing when one slit was detected. With such a configuration of this embodiment, it is possible to positively detect an origin position of the conveying roller by using an existing encoder that is constructed with high resolution, without installing a new electronic device.

Figure 11:
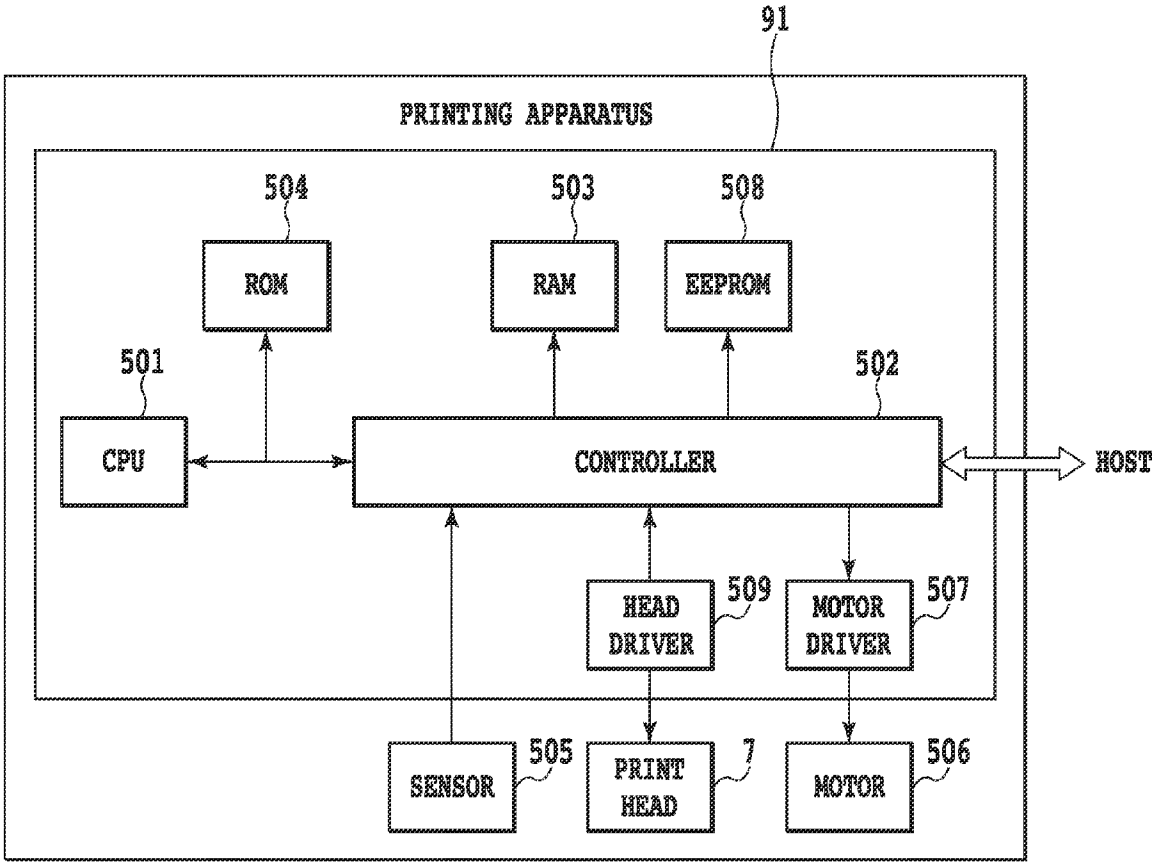
FIG. 11 is a block diagram for explaining a configuration of control of the printing apparatus of the embodiment of the present invention.

FIG. 11 is a block diagram for explaining a configuration of control of the printing apparatus of this embodiment. The CPU 501 controls the mechanisms in the apparatus through a controller 502 according to various programs stored in ROM 504. In doing this, RAM 503 is used as a work area at the time of saving various pieces of data primarily or performing a processing. The CPU 501 performs image processing for converting image data to a printing signal that can be printed by the printing apparatus for the image data received from a host device connected to the outside. Then, the CPU 501 drives a various motor 506 through a motor driver 507 and drives the printing head 7 through a printing head driver 509 to form an image on the print medium. In the figure, the motor 506 and motor driver 507 show collectively the conveying motor 35, the carriage motor 54, the feed motor 99, and their respective drivers that were described previously.

Electrically writable EEPROM 508 stores set-up values at a factory and data to be updated, and this data is used as control parameters by the controller 502 and the CPU 501. A sensor 505 collectively shows the temperature sensors and encoder sensors being set up in various locations in the apparatus, and the above-mentioned conveying roller encoder sensor 363 is one of them. The CPU 501 overwrites count information that was obtained by the conveying roller encoder sensor 363 in detecting the slits to ring buffer of the RAM 503 on an as-needed basis. When the origin is detected, the origin information is stored in another area of the RAM 503 or in the EEPROM.

Figure 12:
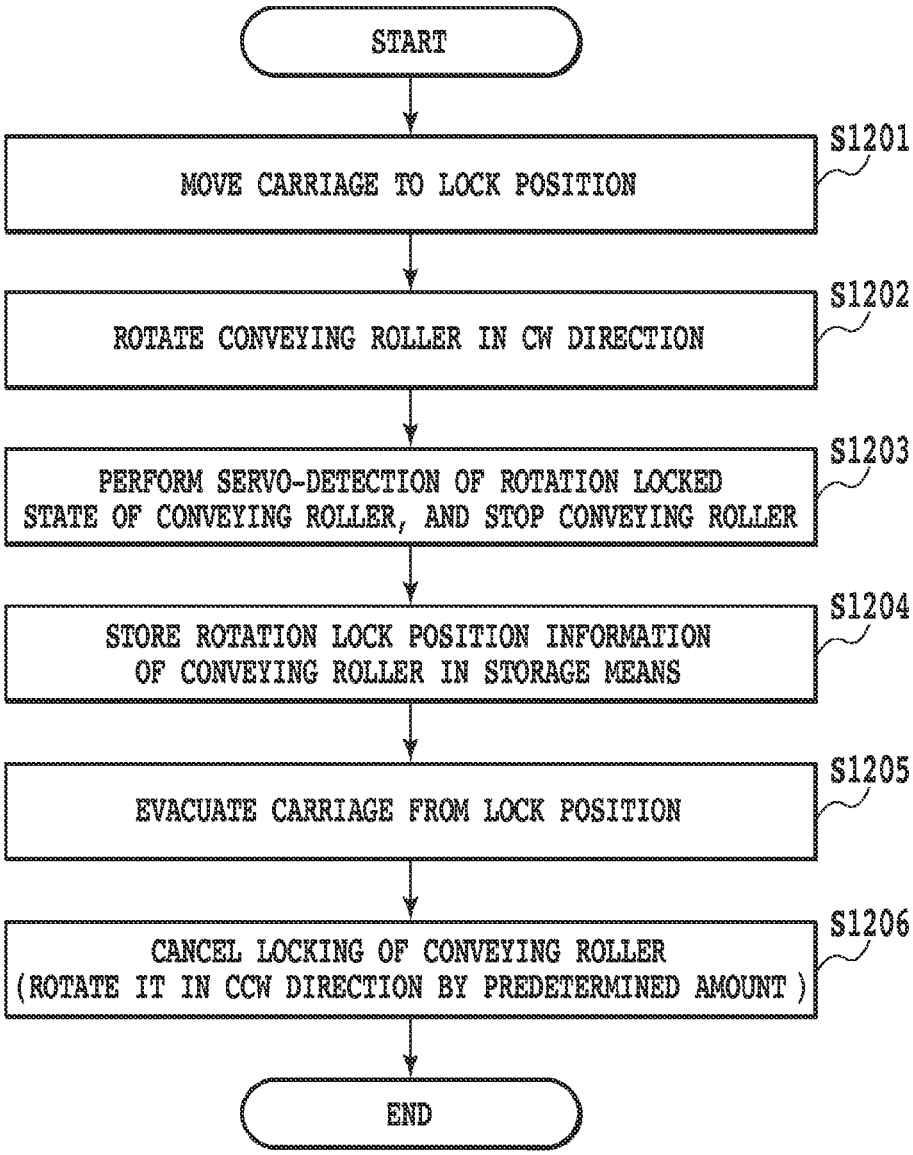
FIG. 12 is a flowchart for explaining steps of a processing that a CPU performs in detecting the origin of the conveying roller in the first embodiment.

FIG. 12 is a flowchart for explaining steps of the processing that the CPU 501 performs in detecting the origin of the conveying roller 36.

When the origin detection processing is started, the CPU 501 moves the carriage 50 to the lock position by driving the carriage motor 54 at Step S1201. Thereby, the protrusion part 50*a* mounted on the carriage 50 bumps against the slope 4003*a* of the lock link lever, the lock link lever 4003 turns, and the stopping lever 4002 abuts against the circumferential part 4001*a* of the lock ring 4001.

In the continuing Step S1202, the CPU 501 rotates the conveying roller 36 in a direction of conveying the print medium (the CW direction in FIG. 7) by driving the conveying motor 35. At this time, detection of the slits of the conveying roller encoder sensor is also performed simultaneously. If the CPU 501 detects the locked state of the conveying roller 36 by the count information of the conveying roller encoder sensor 363, the CPU 501 halts the driving of the conveying motor 35 and stops the conveying roller 36 (Step S1203).

In Step S1204, the CPU 501 stores a rotational position at which the conveying roller encoder sensor 363 detected the locked state in the RAM 503 or the EEPROM 508 as the origin information.

After this, the CPU 501 evacuates the carriage 50 from the lock position at Step S1205. Furthermore, the CPU 501 makes the conveying roller 36 rotate by a predetermined amount in a CCW direction by driving the conveying motor 35 in a direction opposite to the normal direction at Step S1206. Thereby, the concave part 4002*b* of the lock ring gets isolated from the stopping lever 4002. By the above-mentioned way, this processing is completed.

A value that the conveying roller encoder sensor 363 counts for one rotation of the conveying roller 36 is a known fixed value, and this serves as one cycle when the phase is managed. Therefore, in printing operations after the origin detection processing explained above was performed, the phase of the conveying roller 36 can always be grasped from a count value that the conveying roller encoder sensor 363 detects after that, on the basis of the origin information stored at Step S1204. That is, the CPU 501 can convey the print medium in the high precision state, while correcting a conveyance error resulting from eccentricity of the conveying roller by using the rotation amount and the phase of the conveying roller obtained from the conveying roller encoder sensor 363.

Incidentally, in the above, although the embodiment was explained to be configured so that the rotational position at which the conveying roller encoder sensor 363 detected the locked state was stored as the original information, the count value that is stored and upgraded at the timing at which this locked state is detected may be reset to zero. If the follow is modified in this way, the phase control after that can be performed in a state where the count value 0 is assumed as the original.

Note that the phase control after the processing of origin detection that was described above can be correctly performed during a time when the conveying roller encoder sensor 363 is operating. However, if the hard power-off is once done, the conveying roller encoder sensor 363 will become not to operate, and the information in the RAM will be erased; therefore, the origin information and the count values will be lost. Therefore, at the time of returning from the hard power-off, the printing apparatus of this embodiment shall newly re-acquire the origin information by performing a series of origin detection processing steps as shown in the flowchart of FIG. 12.

Moreover, even when the apparatus is in a state of hard power-on, if an emphasis is placed on power saving and extension of life of the encoder, there may be a case where the conveying roller encoder sensor 363 is not operated at the time of soft power-off or at the time of absence of the printing operation. In such a case, the series of origin detection processing steps as shown by the flowchart of FIG. 12 may be performed each time the conveying roller encoder sensor 363 returns to the operation. Moreover, in the case where there is a less fear that the conveying roller 36 is rotated by an external force during stoppage of the conveying roller encoder sensor 363, it is also effective to, just before stopping the operation of the conveying roller encoder sensor 363, store the phase and the origin information at that time.

Furthermore, there is a case where it can be determined that the phase control of the conveying roller 36 is not needed to be performed depending on a kind of image data, a kind of the print medium, etc. In such a case, the above-mentioned origin detection processing may be performed at timing when the printing operation that needs the phase control of the conveying roller 36 is first performed after the soft power-on was done.

In this embodiment explained above, as explained in FIG. 4 and FIG. 5, the locking function is such that the concave part 4001*b* is provided in the lock ring 4001 and a top end of the stopping lever 4002 protrudes into this, but a shape of the lock ring is not limited to this. For example, the same function can be realized by providing a protrusion part in a part of the circumferential part of the lock ring 4001 and configuring the protrusion part so that a top end of the stopping lever 4002 abuts against its side face 4001*c*.

Moreover, although in the above, the embodiment was explained to be configured so that an event that the rotation of the conveying roller 36 is locked is detected using the information of the conveying roller encoder sensor 363, the present invention is not limited to such a configuration. For example, in the case where a rotation ratio of the conveying roller 36 and the discharging roller 40 is 1:1, it is also possible to detect that the conveying roller 36 is in the locked state using the information of the discharging roller encoder 403. Moreover, it is also possible to detect the locked state of the discharging roller 40 by providing a mechanism for locking the roller on the discharging roller 40 side, using the information of the conveying roller encoder sensor 363 and the information of the discharging roller encoder 403. Similarly, gears used for transferring of the driving force, for example, the idler gear 45, may be considered as an object to be locked (stopped), and means for detecting the rotation amount of one of these gears may be provided separately.

As explained in the foregoing, according to this embodiment, it is possible to acquire the origin of the conveying roller with high precision by assembling an existing encoder sensor that is constructed with high resolution and several pieces of cheap mechanical parts, without installing a new electronic device and cable wiring for this.

Second Embodiment

Also in this embodiment, the printing apparatus explained by FIGS. 1 to 5 shall be used. However, in this embodiment, a paper spacing switching mechanism provided on the reverse side of the carriage 50 in advance is also used as means for pressing the lock link lever 4003. This paper spacing switching mechanism is a mechanism that is provided to the carriage in order to adjust a distance between the discharge port plane of the printing head 7 and the print medium depending on a kind of the print medium.

Figure 13A:
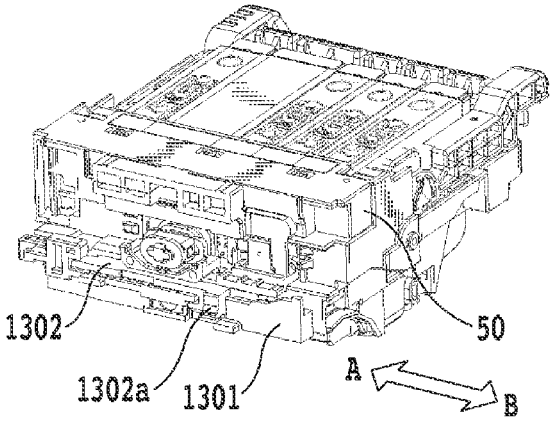
FIGS. 13A to 13C are diagrams for explaining a paper spacing switching mechanism of a second embodiment when the carriage is observed from its reverse side.
Figure 13B:
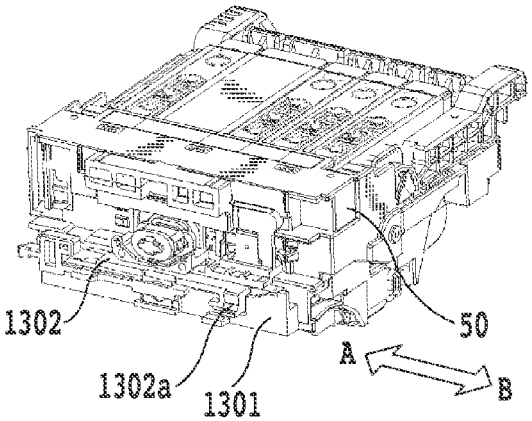
Figure 13C:
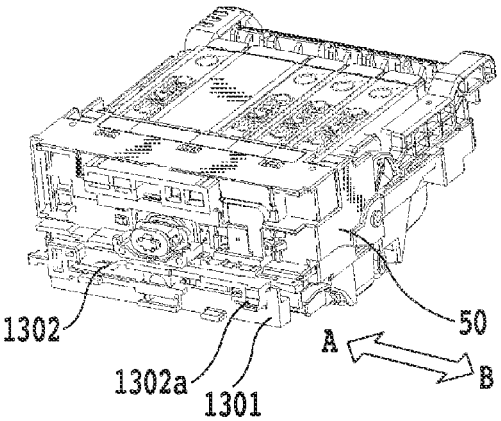

FIGS. 13A to 13C are diagrams for explaining the paper spacing switching mechanism of this embodiment, when the carriage 50 is observed from its reverse side. FIGS. 14 A to 14C are diagrams of a slide bearing 1301 of FIGS. 13A to 13C when being observed from a carriage side.

The slide bearing 1301 is an axial component that slides on the carriage rail 52 when the carriage 50 moves. A paper spacing switching slider 1302 slides in a direction A-B of the figure, being held by the carriage 50 and the slide bearing, whereby it changes a distance between the carriage 50 and the slide bearing 1301, i.e., a height of the carriage 50.

Figure 14A:
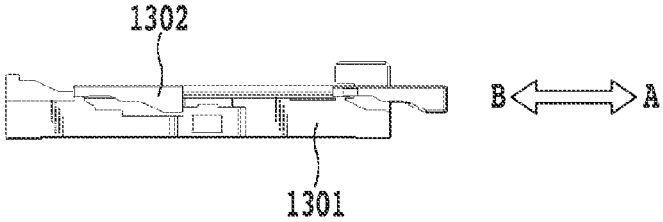
FIGS. 14A to 14C are diagrams of a slide bearing when being observed from a carriage side.
Figure 14B:
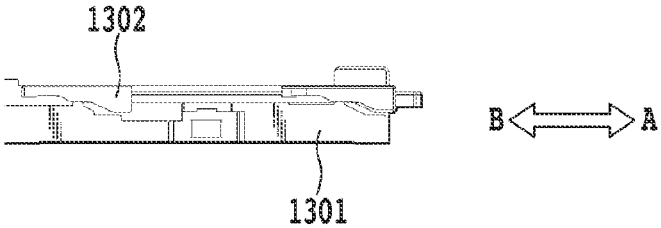
Figure 14C:
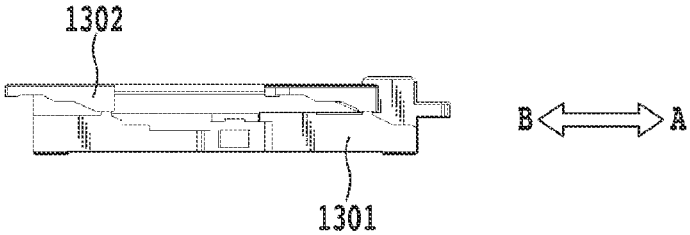

FIG. 13A and FIG. 14A show a state of a narrow paper spacing (normal position) with the position used for printing on a plain paper or photographic special paper. If the carriage 50 is moved in the direction A from this state, since a protrusion part 1302*a* attached to the paper spacing switching slider 1302 is held down by an obstacle, only the carriage 50 and the slide bearing 1301 move in the direction A. That is, a relative position in the horizontal direction between the paper spacing switching slider 1302 and the slide bearing 1301 displaces, and a relative position in the height direction also changes by the mutual slopes. As a result, the carriage mounted on the paper spacing switching slider 1302 rises. FIG. 13B and FIG. 14B show a state where the carriage 50 has risen in this way by one step to be located at a position where the paper spacing is wide that is for printing on a thick paper, etc. (a thick paper position). Moreover, if the carriage 50 is further moved in the direction A by the same method, the carriage 50 will further rise by one more step. FIG. 13C and the FIG. 14C show a state where the carriage 50 further rises by one more step and is located at a position where the paper spacing is the widest (a maximum position), which is at the time of printing a disk such as CD-R. Incidentally, if in a state where the protrusion part 1302*a* is held down by the obstacle, the carriage 50 is moved in the direction B, the carriage 50 can be returned to an original position. The printing apparatus of this embodiment is configured to be able to adjust the paper spacing distance in three stages according to a kind of the print medium by using thus mechanism.

Figure 15A:
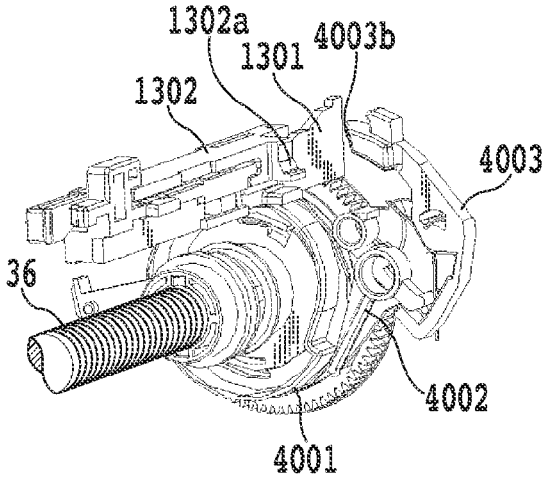
FIGS. 15A to 15C are diagrams showing a relation between the slide bearing and the conveying roller when the carriage moves to a lock position in the cases where a paper spacing is at a normal position, a thick paper position, and a maximum position, respectively.
Figure 15B:
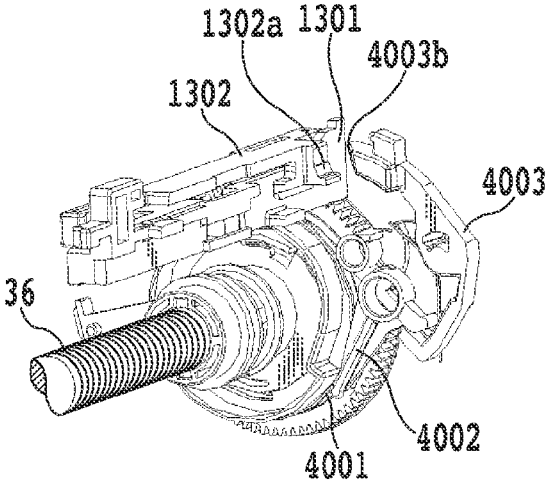
Figure 15C:
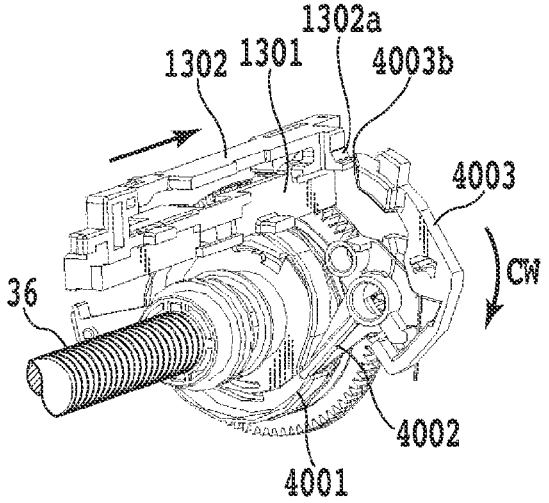

FIGS. 15A to 15C are diagrams each showing a relation of the slide bearing 1301 and the lock mechanism of the conveying roller when the carriage has moved to the lock position in the case where the paper spacing is at the normal position, at the thick paper position, and at the maximum position, respectively. Referring to FIGS. 15A and 15B, even if the carriage 50 has moved to the lock position in the state of the normal position or the thick paper position, the protrusion part 1302*a* keeps to be isolated from the lock link lever 4003; therefore, the lock link lever 4003 will not turn. That is, a function as trigger means has become invalid. On the other hand, referring to FIG. 15C, in the case where the paper spacing is at the maximum position, when the carriage 50 has moved to the lock position, the protrusion part 1302*a* abuts against the slope 4003*a* of the lock link lever 4003; therefore, the lock link lever 4003 turns in the CW direction. That is, a function as the trigger means is kept valid. Incidentally, the apparatus is designed so that a force of turning the lock link lever 4003 may be sufficiently smaller that the slide force of the paper spacing switching slider 1302 in order that the paper spacing switching slider 1302 would not be shifted in turning the lock link lever 4003.

Figure 16A:
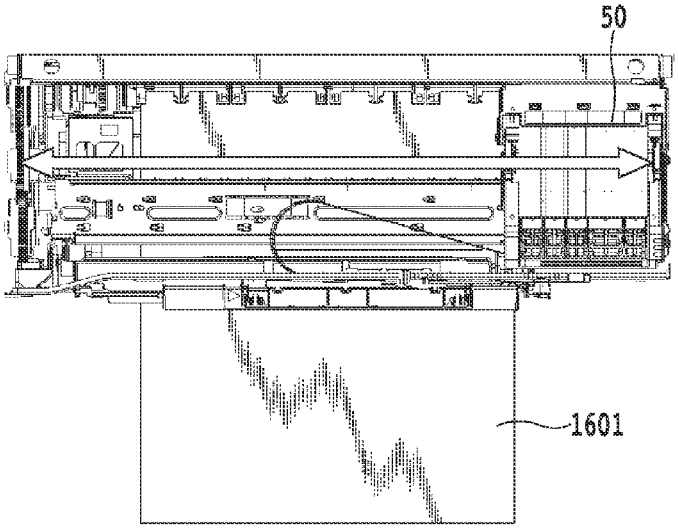
FIGS. 16A and 16B are diagrams for explaining a paper spacing position and a movement area of the carriage in a second embodiment.
Figure 16B:
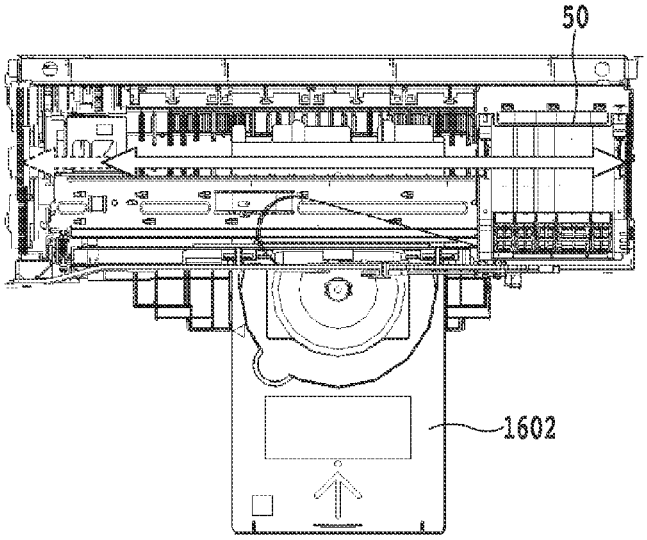

FIGS. 16A and 16B are diagrams for explaining a paper spacing position and a movement area of the carriage 50 in this embodiment. In the case where the print medium is of the fixed size, such as the plain paper, the photographic special paper, or the thick paper, in order to perform printing on the whole area of the print medium in its width direction, the carriage does reciprocation in a range indicated by an arrow of a solid line of FIG. 16A. That is, the carriage 50 moves also to the lock position during the printing operation. However, since the paper spacing position is either the normal position or the thick paper position at this time, even when the carriage 50 reaches the lock position, the protrusion part 1302*a* dose not abut against the slope 4003*a* of the lock link lever 4003, and consequently the lock link lever 4003 does not turn.

In the case where the print medium is CD-R, the carriage only needs to move in a range indicated by an arrow of a solid line of FIG. 16B and does not move to the lock position for printing operation. That is, there is no possibility that the conveying roller 36 may be locked in the midst of performing the printing operation to CD-R. On the other hand, in acquiring the origin information of the conveying roller 36, the paper spacing is set to the maximum position and the carriage 50 is moved to the lock position indicated by an arrow of a broken line.

Figure 18:
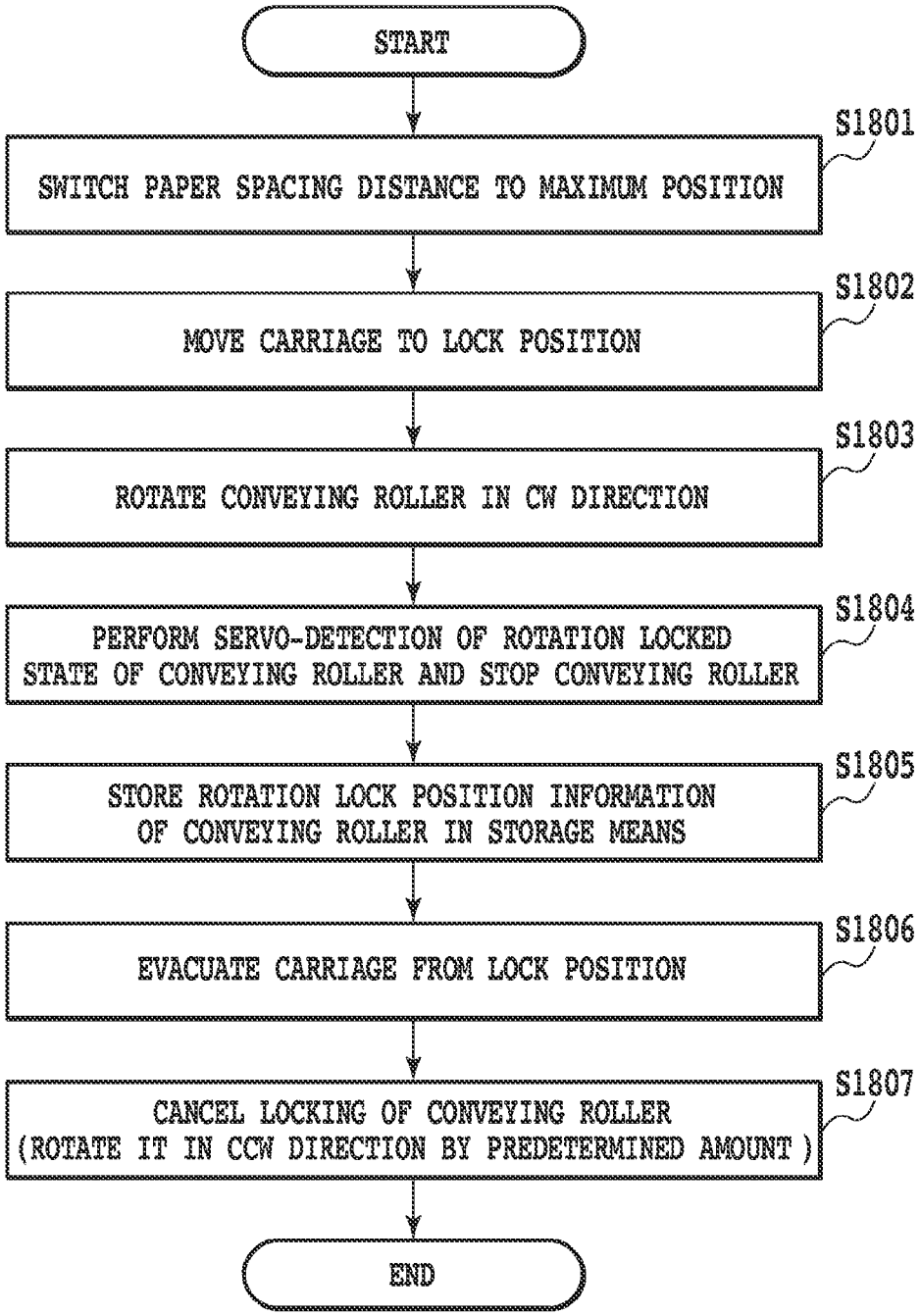
FIG. 18 is a flowchart for explaining steps of a processing that a CPU performs in detecting the origin of the conveying roller in the second embodiment.

FIG. 18 is a flowchart for explaining steps of the processing that the CPU 501 performs in detecting the origin of the conveying roller 36.

In this embodiment, when the origin detection processing is started, first the paper spacing distance is set to the maximum position at step S1801. This may be done by the CPU 501 automatically or the user may be requested to do so. At the continuing Step S1802, the carriage 50 moves to the lock position by driving the carriage motor 54. Since the paper spacing is being set to the maximum position, at timing when the carriage 50 reaches the lock position, the protrusion part 1302*a* abuts against the slope 4003*a* of the lock link lever 4003, which makes the lock link lever 4003 turn. Hereafter, the steps of Step S1803 to Step S1807 are the same as those of the flowchart of FIG. 12 explained in the first embodiment.

In order not to lock the conveying roller 36 in the midst of a printing operation, it is needed that the lock link lever 4003 and the trigger means on the carriage 50 abutting against this abut against each other outside the movement area where the carriage 50 is in the printing operation. That is, in the case where the protrusion part 50*a* fixed on the reverse side of the carriage 50 is used as the trigger means like the first embodiment, an area that is the movement area necessary for the operation of printing on a fixed size print medium added with a width of the lock position is required as a moveable area of the carriage 50. As a result, in the printing apparatus of the first embodiment, the width larger than the width shown in FIG. 16 by an addition of the width of the lock position becomes necessary, which leads to a larger size of the apparatus compared to this embodiment. In the printing apparatus of this embodiment, the lock position of the printing apparatus is included in a usual printing area when the printing area is wide, and becomes as the lock position only when the printing area width is narrow. By this fact, the origin information of the conveying roller can be acquired without incurring enlargement of the printing apparatus, contrary to the first embodiment.

Incidentally, with the above-mentioned configuration, if the printing operation is done on the print medium of the fixed size with the paper spacing of the maximum position, it will become unable to divide the normal printing operation and the origin acquisition operation. However, even in the case like this, if the stroke area of the slider that realizes the same paper spacing may be further widened and the area is brought into correspondence with two positions of the paper spacing switching slider 1303, the above-mentioned problem can be solved.

Figure 17A:
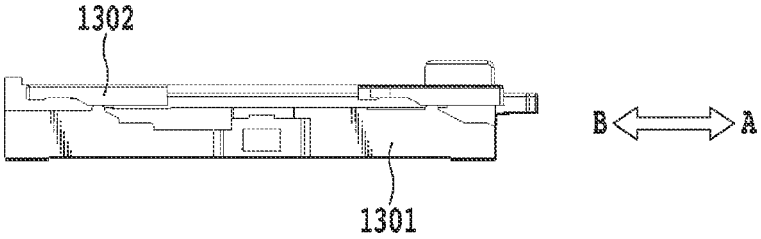
FIGS. 17A and 17B are diagrams for explaining a configuration in which a stroke area at a large-paper-spacing position is brought into correspondence with two positions of a paper spacing switching slider.
Figure 17B:
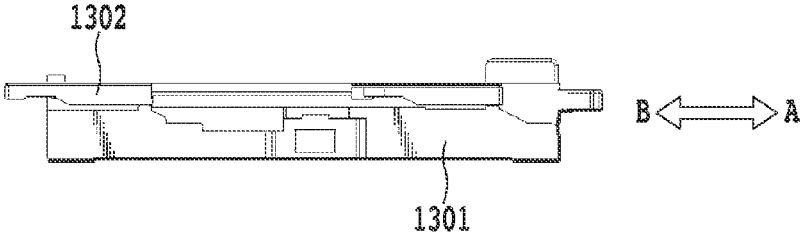

FIGS. 17A and 17B show the configuration of realizing two stage paper spacing, and are diagrams for explaining a configuration in which the stroke area at the large-paper-spacing position is brought into correspondence with the two positions of the paper spacing switching slider 1303. FIG. 17A is a diagram showing a positional relation of the paper spacing switching slider 1303 and the slide bearing 1301 in the case where the paper spacing is wide and the normal printing operation is performed. On the other hand, FIG. 17B is a diagram showing a positional relation of the paper spacing switching slider 1303 and the slide bearing 1301 at the time of acquiring the origin information. Although the paper spacing is in a wide state in either state, the printing apparatus is configured as follows: in the state of FIG. 17A, when the carriage 50 moves to the lock position, the protrusion part does not abut against the lock link lever; and in the state of FIG. 17B, the protrusion part abuts against the lock link lever so as to lock the conveying roller.

As described in the foregoing, according to this embodiment, the printing apparatus is configured so that the protrusion part mounted on the paper spacing switching slider can be used as the trigger means for locking the conveying roller, and the function of the trigger means can be switched to be valid or invalid by the paper spacing switching slider. Thereby, the same effect as that of the first embodiment can be realized, without incurring enlargement of the printing apparatus.

Third Embodiment

Also in this embodiment, the printing apparatus explained by FIGS. 1 to 5 shall be used. However, in this embodiment, the conveying roller is locked by using a trigger component driven by the feed motor. Referring to FIG. 1, the printing apparatus of this embodiment is configured so that the feed roller 28 may rotate in a direction of feeding the print medium by the feed motor 99 making a positive rotation and subsequently the pressure plate 21 may rise. By this series of operations, one sheet of paper that is at the highest position among a plurality of print medium is fed into the inside of the apparatus. Thus, what is necessary in order to prevent the pressure plate 21 from going up until the feed roller 28 makes the predetermined forward rotation amount is just to provide the well-known drive delay mechanism and to secure an insensitive rotation amount. Note that in a state where the pressure plate 21 has not risen in this mechanism, as during waiting of print medium feeding, if the feed motor 99 rotates by a fixed amount in whichever direction, positive direction or reverse direction, the feed roller 28 does not contact with the print medium and the print medium does not move. In this embodiment, the trigger component is made to operate using the normal and reverse rotations of a predetermined amount by the feed roller 28 in a state where the pressure plate 21 does not rise, in this way, and the origin of the conveying roller 36 is acquired.

Figure 19A:
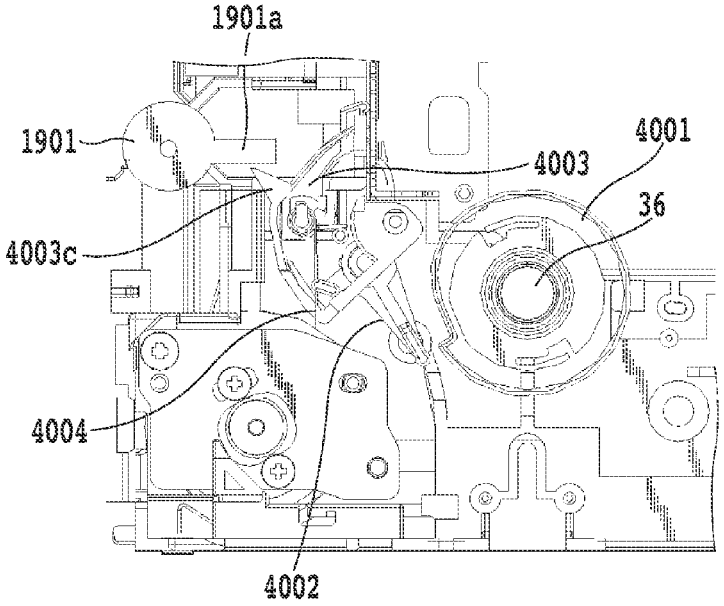
FIGS. 19A and 19B are sectional views for explaining steps where the locking function in the printing apparatus of a third embodiment acts.
Figure 19B:
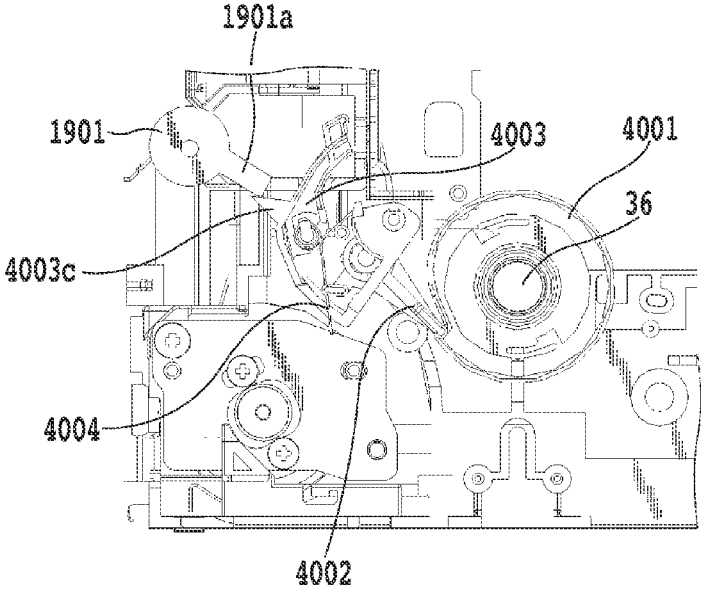
Figure 20:
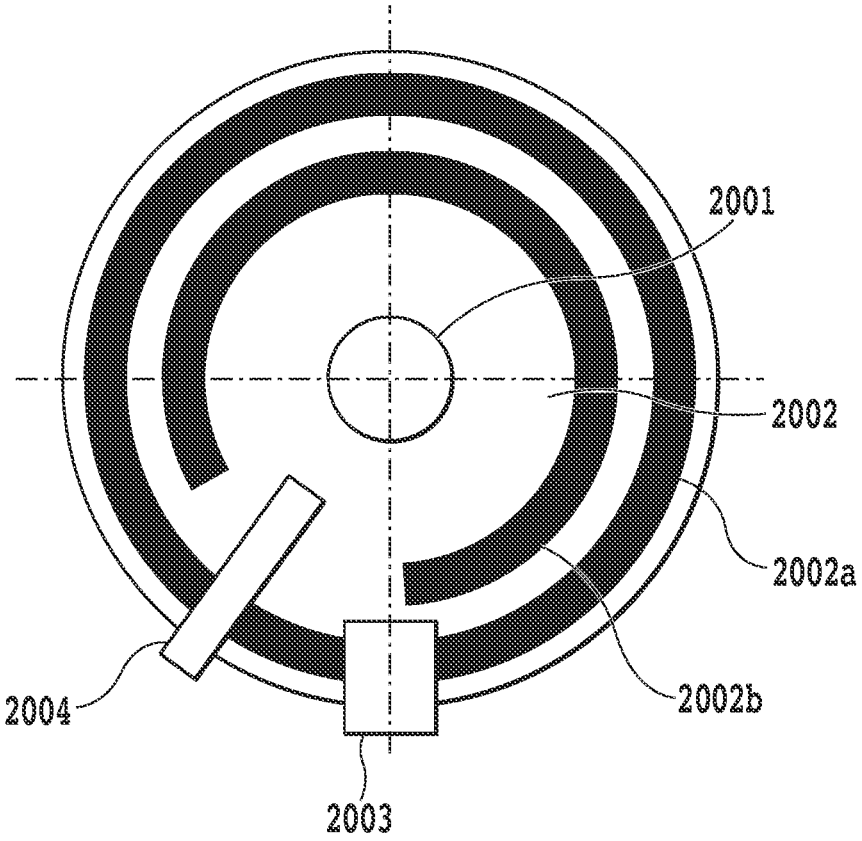
FIG. 20 is a sectional view for explaining an installation state of the code wheel and the sensors.
Figure 21:
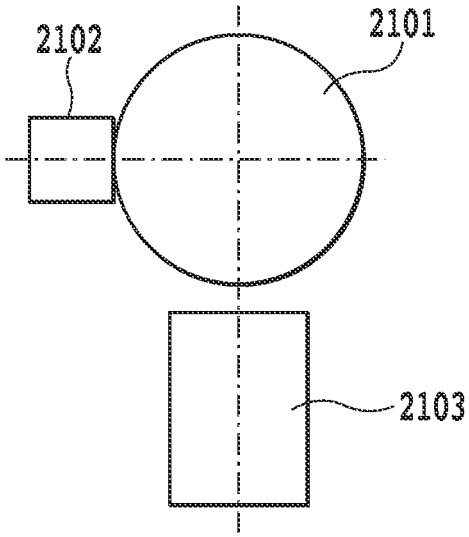
FIG. 21 is a diagram showing another example of a configuration for detecting the origin of the conveying roller.

FIGS. 19A and 19B are sectional views for explaining steps in which the locking function in the printing apparatus of this embodiment acts. The trigger component 1901 is jointed to the feed roller 28 by means of friction rotational joint (torque limiter joint) and is configured so that it may rotate to a position in FIG. 19A when the feed roller 28 rotates in a forward direction and may rotate to a position in FIG. 19B when the feed roller 28 rotates in a reverse direction. When acquiring the origin, if the feed roller 28 is rotated in the reverse direction by a predetermined amount in a state where the pressure plate 21 is lowered, a trigger component 1901 rotates in the CW direction. When the trigger component is rotated to a predetermined rotary position (the lock position), the lever part 1901*a* of the trigger component 1901 abuts against the protrusion part 4003*a* provided in the lock link lever 4003 and pushes this in the downward direction, which makes the lock link lever 4003 turn. If the conveying roller 36*a* is made to rotate in the CW direction in this state, the stopping lever 4002 of the lock link lever 4003 enters into the concave part 4002*a* of the lock ring 4001 by the same mechanism of the above-mentioned embodiment, the conveying roller 36*a* is locked (stopped), and thereby the origin information can be acquired.

After that, if the trigger component 1901 is set back to the position of FIG. 19A by making the feed roller 28 rotate in the forward direction, and subsequently the conveying roller 36 is made to rotate in the CCW direction, the locked state is canceled by an applied force of the stopping lever spring 4004.

As described in the foregoing, according to this embodiment, it is possible to acquire the origin of the conveying roller with high precision by preparing the trigger means that is jointed to the feed roller 28 by means of friction rotational joint, without installing a new electronic device and cable wiring for this.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-215888, filed Aug. 25, 2008 which is hereby incorporated by reference herein in its entirety.

What is claimed is:

1. An apparatus comprising:

a roller;

a rotational member that rotates with the roller, the rotational member having a concave part or a protrusion part;

a contact member that is capable of contacting with the concave part or the protrusion part; and a detecting unit that detects the contact of the contact member with the concave part or the protrusion part, wherein the contact member is incapable of contacting the concave part or the protrusion part at a first position and is capable of contacting the concave part or the protrusion part at a second position, the detecting unit detects the contact when the contact member is in the second position, and a rotational origin of the roller is set based on the detection by the detecting unit.

2. The apparatus according to claim 1, further comprising a carriage movable along a direction parallel to an axis of the roller, wherein the carriage makes the contact member shift from the first position to the second position when the carriage moves toward the rotational member.

3. The apparatus according to claim 2, wherein the contact member shifts from the second position to the first position with an elastic part when the carriage moves apart from the rotational member.

4. The apparatus according to claim 3, wherein the carriage has a portion that pushes the contact member to shift from the first position to the second position when the carriage moves toward the rotational member.

5. The apparatus according to claim 2, further comprising a printing unit having the carriage holding a print head for printing an image on a sheet, and the roller conveys the sheet for printing.

6. The apparatus according to claim 1, wherein a gear for transmitting a drive force to another gear is provided on an axis of the roller, and the rotational member is provided near the gear.

7. The apparatus according to claim 6, further comprising a carriage movable along a direction parallel to an axis of the roller, wherein the rotational member is provided between the gear and the carriage.

8. The apparatus according to claim 7, wherein a diameter of the rotational member is smaller than a diameter of the gear, and the concave part or the protrusion part is formed on the rotational member.

9. The apparatus according to claim 1, further comprising an encoder unit having a code wheel provided on an axis of the roller, a sensor for reading the code wheel, and a counter for counting pulse signals of the sensor, wherein a count value of the counter, at a timing when the detecting unit detects the contact, is reset or is saved as the rotational origin.

10. An apparatus comprising:

a roller;

a rotational member that rotates with the roller, the rotational member having a concave part or a protrusion part;

a contact member that is capable of contacting with the concave part or the protrusion part;

an encoder unit; and a detecting unit that detects the contact of the contact member with the concave part or the protrusion part based on a signal output of the encoder unit, wherein a rotational origin of the roller is set based on the detection by the detecting unit.

11. The apparatus according to claim 10, wherein the contact member is incapable of contacting the concave part or the protrusion part at a first position and is capable of contacting the concave part or the protrusion part at a second position, and the detecting unit detects the contact when the contact member is in the second position.

12. The apparatus according to claim 11, further comprising a carriage movable along a direction parallel to an axis of the roller, wherein the carriage makes the contact member shift from the first position to the second position when the carriage moves toward the rotational member.

13. The apparatus according to claim 12, further comprising a printing unit having the carriage holding a print head for printing an image on a sheet, and the roller conveys the sheet for printing.

14. The apparatus according to claim 10, wherein the encoder unit has a code wheel provided on an axis of the roller, and a sensor for reading the code wheel.

* * * * *